United States Patent [19]

Massard et al.

[11] Patent Number: 4,612,736

[45] Date of Patent: Sep. 23, 1986

[54] METHOD AND APPARATUS FOR BEVELLING OR GROOVING OPHTHALMIC LENSES

[75] Inventors: Christian Massard, Livry Gargan; Alain Pierre; Jean-Louis Roumegoux, both of Paris, all of France

[73] Assignee: Essilor International Cie Generale d'Optique, Creteil, France

[21] Appl. No.: 661,314

[22] Filed: Oct. 16, 1984

[30] Foreign Application Priority Data

Oct. 18, 1983 [FR] France ..... 83 16574

[51] Int. Cl.[4] ..... B24B 9/14

[52] U.S. Cl. ..... 51/284 E; 51/50 PC; 51/101 LG; 51/105 LG; 51/165.71

[58] Field of Search ..... 51/34 E, 34 G, 50 PC, 51/51, 97 NC, 101 LG, 105 LG, 106 LG, 165 R, 165.71, 165.75, 284 E

[56] References Cited

U.S. PATENT DOCUMENTS

| | | | |
|---|---|---|---|
| 1,651,501 | 12/1927 | Baker | 51/101 LG |
| 2,293,291 | 8/1942 | Gaspari | 51/101 LG |
| 3,332,172 | 7/1967 | Stern | 51/101 LG |
| 3,902,283 | 9/1975 | Bean | 51/165.75 X |
| 3,919,811 | 11/1975 | Hedelin | 51/284 E X |
| 4,157,636 | 6/1979 | Wrigglesworth | 51/101 LG |
| 4,173,850 | 11/1979 | Gormish et al. | 51/165 R X |
| 4,195,445 | 4/1980 | Bardonnet | 51/101 LG |
| 4,233,784 | 11/1980 | Loreto | 51/105 LG |
| 4,286,415 | 9/1981 | Loreto | 51/284 |
| 4,512,108 | 4/1985 | Kobayashi | 51/101 LG |

FOREIGN PATENT DOCUMENTS

| | | | |
|---|---|---|---|
| 1956327 | 6/1971 | Fed. Rep. of Germany . | |
| 2211865 | 9/1973 | Fed. Rep. of Germany . | |
| 2481635 | 11/1981 | France . | |
| 2475446 | 9/1984 | France . | |
| 177256 | 10/1983 | Japan | 51/101 LG |
| 2068797 | 8/1981 | United Kingdom | 51/101 LG |
| 2092489 | 8/1982 | United Kingdom . | |

*Primary Examiner*—Robert P. Olszewski

*Attorney, Agent, or Firm*—Charles E. Brown; Charles A. Brown

[57] ABSTRACT

The peripheral edge of an ophthalmic lens is maintained in contact with a bevelling or grooving wheel while being rotated about an axis of the lens parallel to the axis of the bevelling wheel whereby a bevel or groove is formed in said peripheral edge. The ophthalmic lens is capable of relative axial displacement relative to said bevelling wheel. By way of a force or displacement sensor, the relative axial position of the ophthalmic lens with respect to the bevelling wheel can be made subject to the axial component of reaction forces generated between the lens and the bevelling wheel in their mutual contact zone.

16 Claims, 5 Drawing Figures

METHOD AND APPARATUS FOR BEVELLING OR GROOVING OPHTHALMIC LENSES

BACKGROUND OF THE INVENTION

The present invention relates generally to the bevelling or grooving of an ophthalmic lens.

It is known to retain an ophthalmic lens in the rim or surround of a spectacle frame, by providing the rim or surround with an annular groove, commonly called a bezel, and by providing on the peripheral edge of the ophthalmic lens, after the latter has been trimmed to the contour of the said rim or surround, a rib or bevel, usually of triangular cross-section, which is arranged to be engaged in the said groove.

Alternatively, it is appropriate to form a groove in the lens when the particular rim or surround of the spectacle frame possesses a tab and/or a wire for retaining the lens.

Simply for the sake of convenience, the following description will most often be confined to the bevelling necessary for forming a rib or bevel in the lens, although the process of the invention be equally used to form a groove.

The bevelling and the preceding trimming operations are usually carried out on a grinding machine equipped for this purpose with at least one bevelling wheel.

On such a grinding machine, the opthalmic lens to be bevelled is maintained by means of its edge in contact with the bevelling wheel, and it is rotated on itself about an axis parallel to the axis of the wheel.

It is, of course, important that the bevel formed on the ophthalmic lens should be accurately on its edge between the ridges of its periphery.

In practice, in order to take into account both the intrinsic curvature of such an ophthalmic lens and the possible variations in its thickness, particularly when a lens of continuously variable focal power, called a progressive lens, is concerned, as well as the "meniscus effect" which the rim or surround, in which it is to be mounted, moreover possesses in its own right, that is to say the intrinsic curvature of this rim or surround, it is necessary to displace the lens parallel to its axis during its rotation relative to the bevelling wheel, in such a way that its point of contact with the wheel follows a suitable path between the ridges of its periphery.

In other words, it is necessary to provide a capability of relative axial displacement between the ophthalmic lens and the bevelling wheel.

The relative axial displacement to be exerted in this way on the ophthalmic lens to be bevelled can be carried out manually.

However, this requires a certain skill on the part of the operator, since the corresponding bevelling of the lens is carried out visually.

Consequently, the results of such an operation are always approximate.

Alternatively, the relative axial displacement of the ophthalmic lens to be bevelled can take place freely by the use of a double-slope bevelling wheel, into the groove of which the entire edge of the lens penetrates so that the lens is therefore automatically continuously centred.

However, such an arrangement is only suitable in practice for ophthalmic lenses which are relatively thin and have a uniform curvature.

For example, when an ophthalmic lens with a thick edge, especially a toric ophthalmic lens, is to be processed, the width which the double-slope bevelling wheel to be used must process quickly becomes prohibitive.

As a corollary to this, when a progressing ophthalmic lens having a variable thickness over its periphery, is to be processed, the bevel to be formed can "exceed" the limits of this periphery in the thinnest zone of the lens in question, or in other words can be inopportunely absent in this thin zone.

Consequently, for the construction of automatic grinding machines designed especially for the processing of such lenses, it has been proposed to control the relative axial displacement of the ophthalmic lens to be bevelled relative to the corresponding grinding wheel such that the point of contact of the ophthalmic lens with this grinding wheel follows a specific path.

Such a control can be systematic, irrespective of the particular characteristics of the lens to be bevelled.

However, whether the axial guidance of the lens is controlled mechanically or by way of a program, only a limited number of possible bevel paths is usually available. For example, three or four such paths may be available, and the operator must select from those that path which seems the most suitable to him, taking into account the particular characteristics of the lens to be processed.

Thus, as before, the operator must necessarily be a specialist.

It has also been proposed to subject the axial guidance of the lens to be processed directly to the particular characteristics of the lens.

This, is the case, for example, in the French Patent Application No. 2,475,446, which describes a first phase corresponding to pre-bevelling carried out by means of a double-slope bevelling wheel, the path followed by the bevel of the lens being recorded by means of detection of the axial displacement of this lens during bevelling, and the axial displacement of the latter taking place freely at this time. In a second phase, during an operation of the finishing bevelling of the said lens, a systematic axial displacement of the latter, corresponding to the previously recorded bevel path, is carried out.

However, as before, such a process is only suitable for lenses which are relatively thin and have a uniform curvature, since if, where the processing of relatively thick or progressive ophthalmic lenses is concerned, pre-bevelling is not carried out in an appropriate way for the reasons mentioned above, the same applies automatically to the final finishing bevelling.

SUMMARY OF THE INVENTION

It is an object of the present invention to provide a process and apparatus which, by reducing the difficulties discussed above, make it possible to carry out automatic bevelling or grooving of any ophthalmic lens, whatever the particular characteristics of the lens.

According to a first aspect of the invention there is provided a method for bevelling or grooving an edge of an ophthalmic lens, the process comprising maintaining the peripheral edge of an ophthalmic lens in contact with a bevelling or grooving wheel, and rotating the ophthalmic lens about an axis of the lens, the lens axis extending substantially parallel to the axis of the said bevelling or grooving wheel, the ophthalmic lens and the bevelling or grooving wheel being arranged to permit relative axial displacement therebetween, wherein the relative axial position of the ophthalmic lens in relation to the bevelling or grooving wheel is subject to a physical variable related to the axial component of reaction forces generated between said ophthalmic lens and said bevelling or grooving wheel in their mutual contact zone.

This physical variable can be, for example, a force or a displacement.

At all events, the physical variable is independent of the particular characteristics of the lens, the only characteristic of the lens which is involved being the axial bias generated between the lens and the bevelling or grooving wheel when the lens is engaged in the throat of the wheel.

The invention also extends to apparatus for the bevelling or grooving of an ophthalmic lens, the apparatus comprising a stand, a first rotatable support spindle, supported by said stand, at least one bevelling or grooving wheel carried by said first support spindle, drive means arranged to rotate said first support spindle, a second rotatable support spindle extending substantially parallel to said first support spindle, said second support spindle being arranged to hold an ophthalmic lens axially in line with the bevelling or grooving wheel to ensure contact between the peripheral edge of the said ophthalmic lens and the said bevelling or grooving wheel, said second support spindle being mounted on the said stand so as to be movable transversely relative to the axis of the first support spindle, and means arranged to bias said second support spindle towards said first support spindle, wherein one of said support spindles is mounted on the stand so as to be movable parallel to its own axis, the apparatus further comprising advancing means arranged to cause displacement of said one support spindle parallel to its own axis, and a sensor means responsive to the other of said support spindles said sensor means being sensitive to a physical variable related to the axial component of reaction forces generated between the ophthalmic lens and the bevelling or grooving wheel in their mutual contact zone, and said advancing means being arranged to cause displacement of said one support spindle subject to the said sensor means.

BRIEF DESCRIPTION OF THE DRAWINGS

An embodiment of the present invention will hereinafter be described, by way of example, with reference to the accompanying drawings, in which.

DESCRIPTION OF A PREFERRED EMBODIMENT

Figure 1:
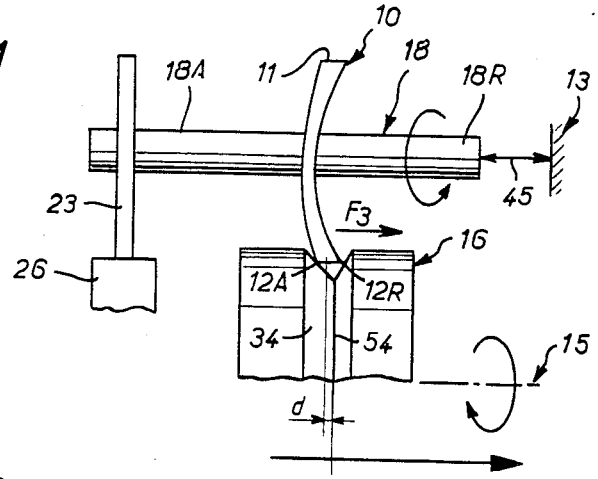
FIG. 1 is a diagrammatic elevation illustrating a process of the invention.

The Figures illustrate a process of the invention in a case where it is intended to form a rib or bevel on the peripheral edge 11 of a previously trimmed ophthalmic lens 10, between ridges 12A, 12R of the lens 10. The rib or a bevel may be designed for engagement in the groove or bezel of the rim or surround of a spectacle frame in which the lens is to be mounted.

The grinding machine to be used for such a bevelling process is mounted at a corresponding machining station on a stand 13 which will not be described in detail herein as it is within the knowledge of a person skilled in the art. The grinding machine generally comprises a first support spindle 15 carrying at least one bevelling wheel 16 and mounted for rotation by way of a drive motor 17, and a second support spindle 18 arranged to extend substantially parallel to said first spindle 15. The second support spindle 18 is also mounted for rotation in the same way as the first spindle and is arranged to grip the ophthalmic lens 10 axially in line with the bevelling wheel 16 to thereby ensure contact between the edge 11 of said ophthalmic lens 10 and the said bevelling wheel 16.

In a manner known per se, the second support spindle 18 is formed by two half-spindles 18A, 18R which are arranged in alignment with one another on either side of a working zone 19 in which the ophthalmic lens 10 to be processed is to be positioned. Each half-spindle 18A, 18R is rotatably mounted in a respective support bush 22A, 22R in which bearings 20 are provided.

At its end remote from the working zone 19, the half-spindle 18A is arranged to carry a template 23 plumb with a bracket 24. The bracket 24 is integral with the stand 13 and carries a contact 26 intended to interact with the said template 23. The position of the contact 26 is adjustable by way of a control knob 25 which is available to the user.

At its end remote from the working zone 19, the half-spindle 18R is coupled to a control handle 28 which is available to the user and which makes it possible for the axial approach of the half-spindle 18R towards the associated half-spindle 18A to be controlled. This relative axial movement of the half-spindles 18A and 18R enables the half-spindles to clamp and thus retain an ophthalmic lens 10 to be processed.

The support spindle 18 consisting of the two half-spindles 18A, 18R is mounted on the stand 13 so as to be movable as a whole transversely relative to the axis of the first support spindle 15 under the control of biasing means arranged to urge the second spindle 18 towards the first support spindle 15.

Figure 4:
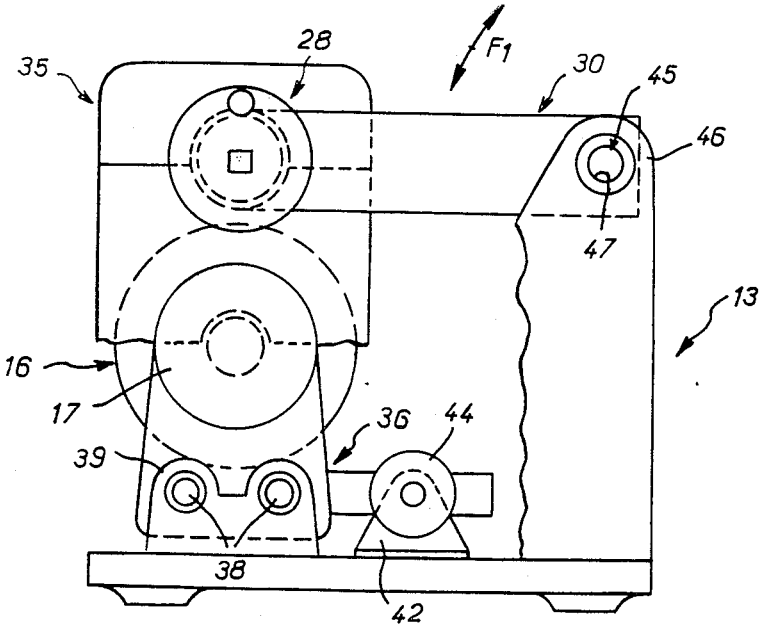
FIG. 4 is a view of the machine, partly in a side elevation, taken in the direction of arrow IV of FIG. 3.

In the embodiment illustrated, the support bushes 22A, 22R for the half-spindles 18A, 18R are formed in a support block 30, and this support block 30 is engaged on a pivoting spindle 31 such that the block 30 can be articulated on the stand 13 as indicated by the double arrow F1 shown in FIG. 4.

In the illustrated embodiment, the pivoting spindle 31 of the support block 30 is rotatably mounted with swivelling, in lugs 32A, 32R carried by the stand 13. The spindle 31 is retained axially relative to the stand 13, with some axial play, by means of elastic split rings 33A, 33R which are engaged in corresponding flutes provided on the periphery of said spindle 31 and which are designed to come into contact with the said lugs 32A, 32R.

The working zone 19 extends above the bevelling wheel 16, and thus it is gravity along which, in the illustrated embodiment, constitutes the biasing means acting to constantly urge the support spindle 18 for the ophthalmic lens 10 to be processed, in the direction of the support spindle 15 of the bevelling wheel 16.

For the bevelling of the lens, the bevelling wheel 16 has a groove 34 of V-shaped cross-section in its central zone.

In the embodiment illustrated, a single cover 35 encloses the working zone 19, in which the ophthalmic lens 10 on the one hand and the bevelling wheel 16 on the other hand are located.

Of course, the grinding machine comprises means (not shown) arranged to cause rotation of the support spindle 18 about its own axis and to thereby cause the ophthalmic lens 10 to be itself rotated about the said axis when the peripheral edge 11 of the lens is in contact with the throat 34 of the bevelling wheel 16. Generally, the means for rotating the spindle 18 would be provided in the support block 30. As such means and the manner of their operation are known per se they are not further described herein.

The ophthalmic lens 10 to be processed is arranged to be relatively axially displaceable with respect to the bevelling wheel 16. In this respect, at least one of the support spindles 15, 18, called the movable support spindle below for convenience, is mounted on the stand 13 so as to be movable parallel to its own axis by way of advancing means.

Figure 3:
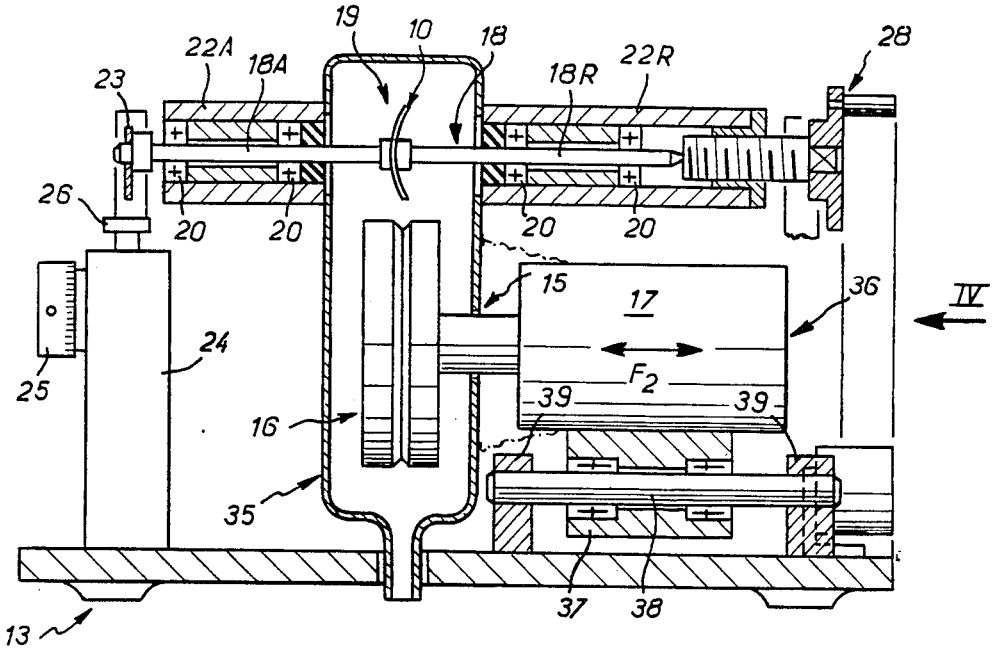
FIG. 3 shows an axial section taken along line III—III of the machine of FIG. 2.
Figure 2:
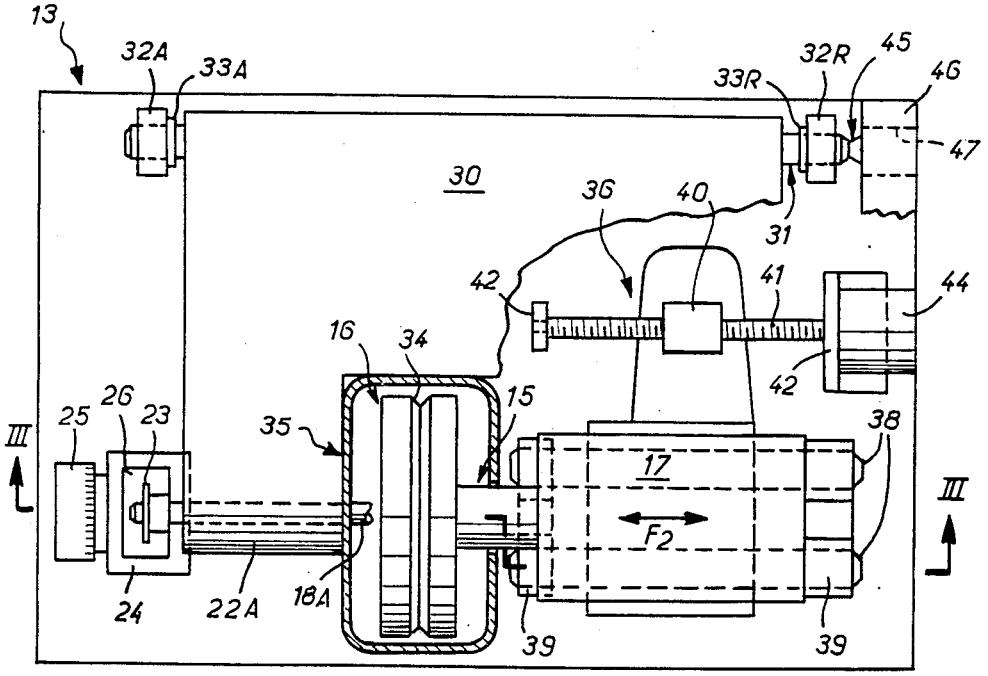
FIG. 2 is a plan view, partly in section, of a grinding machine for putting this process into practice.

In the embodiment illustrated, it is the supporting spindle 15 carrying the bevelling wheel 16 which is the movable spindle. In this respect, the support spindle 15, and also the bevelling wheel 16 and the drive motor 17, are carried by a carriage 36 mounted on the stand 13 to be movable parallel to the axis of the spindle 15 as indicated by the double arrow F2 of FIGS. 2 and 3.

In the embodiment illustrated, the carriage 36 is engaged by way of sleeves 37, for example, sleeve bearings, with two guides 38. These guides 38 extend parallel to one another and are carried by lugs 39 integral with the stand 13.

By means of a tapped nut 40, the carriage 36 is engaged with a threaded rod 41 which is rotatably mounted between two lugs 42 integral with the stand 13. The threaded rod is rotationally fixed to the output shaft of a stepping motor 44 which forms the associated advancing means.

A sensor 45 is provided and, controlled by the support spindle 18 or a member connected thereto, is arranged to be sensitive to a physical variable related to the axial component $F_3$ of the reaction force which is generated between the ophthalmic lens 10 and the bevelling wheel 16 in their mutual contact zone. Thus, when an ophthalmic lens 10 is engaged by means of its peripheral edge 11 in the groove 34 of the said bevelling wheel 16, and advancing means, in this particular case the motor 44, controlling the movable support spindle 15 are subject to the said sensor 45.

In the embodiment illustrated in the Figures, this sensor 45 is a force sensor arranged against the stand 13, and more specifically against a bracket 46 integral with the latter, at the end of the pivoting spindle 31 of the support block 30. For example, the sensor 45 may be engaged in a recess 47 in this bracket 46, as is illustrated. The sensor may, for example, utilize a bending beam or a strain gauge or, more generally, any member sensitive to a force.

Alternatively, the sensor may also be a displacement or, more specifically, a micro-displacement sensor or reader, for example an electronic rule.

Figure 5:
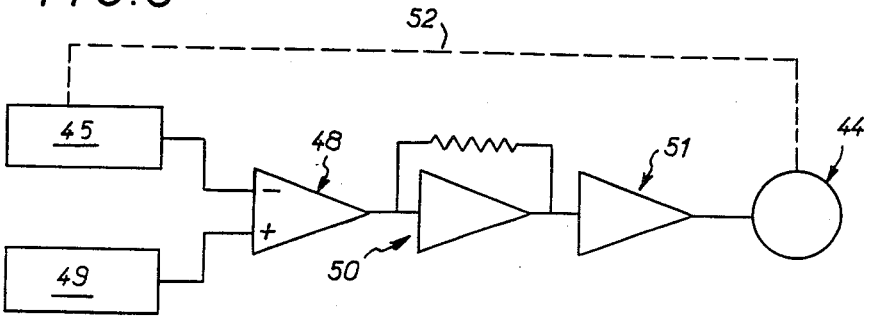
FIG. 5 is a block diagram illustrating the control chain for the machine.

At all events, as illustrated in FIG. 5, the output of the sensor 45 is connected to one of the inputs of a comparator 48. The other input of the comparator 48 is connected to an indicator 49 arranged to display a desired value. The output of the comparator 48 is arranged to control, by means of a conventional network of correctors 50 and a power amplifier 51, the advancing motor 44 which a feedback connected 52 indicated by broken lines connects to the sensor 45 in a likewise conventional way.

The desired value which the indicator 49 can be arranged to display can be positive, negative or zero.

When the sensor 45 used is a force sensor, the desired value can be, for example, between 10 and 30 g, preferably close to 20 g.

It goes without saying that these values, given here simply by way of example to illustrate the invention, in no way limit the latter.

During operation, a previously rough-machined ophthalmic lens 10 to be processed is placed in contact with the bevelling wheel 16 as illustrated in FIG. 1, the peripheral edge 11 of the lens being engaged in the groove 34 of the bevelling wheel 16. The lens is normally centred automatically in this groove 34, because of the V-shaped transverse profile of the groove, and thus reaction forces generated by contact between the flanks of the groove and corresponding points on the ridges 12A, 12R of the lens periphery are generally balanced.

FIG. 1 illustrates a situation in which the lens 10 has become off-centre by a value d which is the distance measured between the root edge 54 of the groove 34 of the bevelling wheel 16 and the center line of the peripheral edge 11 of the ophthalmic lens 10. If such off-centring occurs, reaction forces are generated between the opthalmic lens 10 and the bevelling wheel 16, the reaction forces having an axial component $F_3$ which is in the direction opposite to that of the off-centring.

If, for example, the off-centring is negative, as illustrated, the axial component $F_3$ is positive.

In practice, this axial component $F_3$ of the reaction forces is absorbed by the support spindle 18 of the ophthalmic lens 10. The support spindle 18 transmits the axial force component to the support block 30, and it is then applied by the pivoting spindle 31 to the sensor 45 which records its value at any instant for comparison with the desired value displayed by the indicator 49.

If the value sensed is different from the desired value, the motor 44 is caused to be operated in a direction suitable to reduce the difference by corresponding displacement of the carriage 36 and consequently of the spindle 15 carrying the bevelling wheel 16.

The reaction time between the initial measurement made in this way by the sensor 45 and the operation of the advancing motor 44 can be very short, for example of the order of a few microseconds.

Because of the relatively low rotational speed of the spindle 18 carrying the ophthalmic lens 10, for example of the order of about 10 revolutions per minute, the reaction time corresponds to an extremely small angle of rotation of the ophthalmic lens 10 about is axis of the order of a few thousandths of a revolution.

At all events, relative axial displacement of the ophthalmic lens 10 relative to the bevelling wheel 16 is ensured such that the axial component of the reaction forces generated between the lens and the bevelling wheel 16 are maintained at a predetermined constant value, zero if appropriate.

In the foregoing, it is the support spindle 15 of the bevelling wheel 16 which is mounted to be axially movable. Of course, it would just as well be the support spindle 18 of the ophthalmic lens 10 which is movable. In this case the sensor would be arranged to be sensitive to the axial component of the reaction forces to which the support spindle 15 is subjected and/or to the displacement of said spindle 15.

In more general terms, the physical variable, force or displacement, to be detected can be recorded by such a sensor in line with either one of the support spindles 15, 18 or with any member connected to the corresponding spindle. For example, the sensor could be responsive to any other spindle connected to the relevant support spindle, and in this case the other of these support spindles would be mounted to be axially movable under the control of the associated advancing means.

When a desired value is displayed by the indicator 49, the bevel formed by the bevelling wheel 16 on the peripheral edge 11 of the ophthalmic lens 10 being processed is obviously offset either towards the front face of this ophthalmic lens or towards its rear face relative to the centre line of this edge 11, depending upon the sign of this desired value.

However, when this desired value is zero, the bevel formed is exactly centred on the centre line of the edge 11 of the ophthalmic lens 10.

The present invention is not limited to the embodiment described and illustrated, but embraces alternative embodiments. For example, the support block in which the support spindle of the lens to be bevelled is arranged may be mounted to slide on the stand rather than to be pivotable relative thereto. In this case, if the movable support spindle is that which carries the bevelling wheel, the sensor used must be responsive to the support spindle for the lens to be bevelled or to a member connected to this support spindle.

If desired, particularly when the bevelling of simple sun-glasses lenses with a parallel face is concerned, the sensor can be removed or disconnected.

The apparatus and method of the invention is not limited only to the bevelling of ophthalmic lenses, but extends just as well to the grooving of lenses.

In more general terms, the invention relates to the formation on the peripheral edge of an ophthalmic lens of an engagement means, for example, a rib or groove, corresponding to that which the rim or surround of the spectacle frame, in which the lens is to be mounted, possesses for its retention.

What is claimed is:

1. A method for bevelling or grooving a peripheral edge of an ophthalmic lens having an axis, said method comprising the steps of maintaining the peripheral edge of an ophthalmic lens in contact with a bevelling or grooving wheel having an axis while rotating the ophthalmic lens about the axis of the ophthalmic lens, the lens axis extending substantially parallel to the axis of the bevelling or grooving wheel, allowing relative axial displacement between the ophthalmic lens and the bevelling or grooving wheel thereby producing reaction force generated between the ophthalmic lens and the bevelling or grooving wheel in a zone of mutual contact including an axial component when the peripheral edge of the lens is not aligned with the bevelling or grooving wheel, detecting a physical variable related to the axial component of the reaction forces and adjusting the axial position of the ophthalmic lens relative to the bevelling or grooving wheel in response to the physical variable detected in order to reduce the misalignment of the peripheral edge of the ophthalmic lens relative to the bevelling or grooving wheel.

2. A method according to claim 1, wherein the physical variable is an axial displacement.

3. A method according to claim 1, wherein prior to carrying out said steps the ophthalmic lens is rough machined and has a bevel or groove on its peripheral edge.

4. A method according to claim 1, wherein the axial component of the generated reaction forces is recorded at every instant, the adjusting of the axial position of the ophthalmic lens relative to the bevelling or grooving wheel being carried out so as to maintain the axial component of the reaction forces at a predetermined contact value.

5. A method according to claim 1, wherein the axial component of the generated reaction forces is continuously compared with a preselected value, the adjusting of the axial position of the ophthalmic lens relative to the bevelling or grooving wheel being effected in order to cancel any difference between the axial component and the preselected value wherein the physical variable is a force.

6. Apparatus for the bevelling or grooving of an ophthalmic lens, the apparatus comprising a stand (13), a first rotatable support spindle (15), supported by said stand, at least one bevelling or grooving wheel (16) carried by said first support spindle (15), drive means (17) arranged to rotate said first support spindle, a second rotatable support spindle (18) extending substantially parallel to said first support spindle, said second support spindle being arranged to hold an ophthalmic lens (10) axially in line with the bevelling or grooving wheel (16) to ensure contact between the peripheral edge of the ophthalmic lens (10) and said bevelling or grooving wheel (16), said second support spindle being mounted on said stand (13) so as to be movable transversely relative to the axis of the first support spindle (15), and means arranged to bias said second support spindle towards said first support spindle, wherein one of said support spindles is mounted on the stand (13) so as to be movable parallel to its own axis, the apparatus further comprising advancing means arranged to cause displacement of said one support spindle parallel to its own axis, and a sensor means 45 responsive to the other of said support spindles (15, 18), said sensor means being sensitive to a physical variable related to the axial component of reaction forces generated between the ophthalmic lens (10) and the bevelling or grooving wheel (16) in their mutual contact zone, and said advancing means being arranged to cause axial displacement of said one support spindle subject to input from said sensor means (45) so as to reduce the misalignment of the peripheral edge of the ophthalmic lens relative to the bevelling or grooving wheel.

7. Apparatus according to claim 4, wherein said sensor means (45) is a force sensor means arranged against the stand (13) at the end of said other support spindle.

8. Apparatus according to claim 6, wherein said sensor means (45) is a force sensor means arranged against the stand (13) on a member connected to said other support spindle.

9. Apparatus according to claim 6, wherein said sensor means (45) is a displacement sensor means carried by the stand (13) and located opposite to a part of said other support spindle.

10. Apparatus according to claim 6, wherein said sensor means (45) is a displacement sensor means carried by the stand (13) and located opposite to a part connected to said other support spindle.

11. Apparatus according to claim 6, wherein said first support spindle is the one spindle displaceable by said advancing means, said first support spindle (15) being carried by a carriage (36) mounted on the stand (13) so as to be movable parallel to the axis of the first spindle under the control of said advancing means.

12. Apparatus according to claim 10, in which the second support spindle (18) is carried by a support block (30) which is engaged on a pivoting spindle (31) arranged to articulate the support block relative to the stand (13), said sensor means (45) being arranged at the end of said pivoting spindle (31).

13. Apparatus according to claim 6, further comprising control means for said advancing means, said control means comprising a comparator having first and second inputs and an output, and means establishing a desired value connected to the second input of said comparator, the output of said sensor means being connected to the first input of the comparator, and the output of the comparator being connected to control said advancing means.

14. Apparatus according to claim 10, further comprising control means for said advancing means, said control means comprising a comparator having first and second inputs and an output, and means establishing a desired value connected to the second input of said comparator, the output of said sensor means being connected to the first input of the comparator, and the output of the comparator being connected to control said advancing means.

15. Apparatus according to claim 11, further comprising control means for said advancing means, said control means comprising a comparator having first and second inputs and an output, and means establishing a desired value connected to the second input of said comparator, the output of said sensor means being connected to the first input of the comparator, and the output of the comparator being connected to control said advancing means.

16. Apparatus for bevelling or grooving a peripheral edge of an ophthalmic lens, said apparatus comprising a bevelling or grinding wheel having an axis of rotation, means mounting an ophthalmic lens for rotation about an axis extending substantially parallel to the axis of said bevelling or griding wheel, means maintaining the peripheral edge of the ophthalmic lens in contact with the bevelling or grooving wheel, means mounting a selected one of the ophthalmic lens and said bevelling or grinding wheel for axial displacement relative to the nonselected one of the ophthalmic lens and said bevelling or grooving wheel, whereby reaction forces are generated between the ophthalmic lens and said bevelling or grooving wheel in a zone of mutual contact when the peripheral edge of the ophthalmic lens is not axially aligned with said bevelling or grooving wheel, means for detecting a physical variable related to the axial component of the reaction forces, and means responsive to said means for detecting a physical variable for adjusting the axial position of the ophthalmic lens relative to the bevelling or grooving wheel in order to reduce the misalignment of the peripheral edge of the ophthalmic lens relative to the bevelling or groove wheel.

* * * * *